US005817037A

United States Patent [19]

Zurbay

[11] Patent Number: 5,817,037

[45] Date of Patent: Oct. 6, 1998

[54] SOFT TISSUE INJURY TREATMENT APPARATUS AND METHOD

[76] Inventor: Gregory J. Zurbay, 4238 Thomas Ave., North, Minneapolis, Minn. 55412

[21] Appl. No.: 791,916

[22] Filed: Jan. 31, 1997

[51] Int. Cl.[6] ..... A61H 15/00

[52] U.S. Cl. ..... 601/135; 601/15; 601/137

[58] Field of Search ..... 601/15, 72, 73, 601/80, 107, 133–137

[56] References Cited

U.S. PATENT DOCUMENTS

| | | | |
|---|---|---|---|
| D. 272,090 | 1/1984 | Hosid | D24/36 |
| D. 304,495 | 11/1989 | Tyo et al. | D24/36 |
| 2,017,400 | 10/1935 | Hoyer | 601/135 |
| 3,610,232 | 10/1971 | Aisenstadt | 601/15 |
| 3,645,257 | 2/1972 | Nakayama | 601/135 |
| 3,957,039 | 5/1976 | Ehren | 601/119 X |
| 4,483,328 | 11/1984 | Wolocko | 601/135 |
| 4,502,469 | 3/1985 | Jaw | 601/15 |
| 4,590,926 | 5/1986 | Courtin | 601/134 X |
| 4,745,909 | 5/1988 | Pelton et al. . | |
| 4,785,800 | 11/1988 | Stilson . | |
| 4,807,803 | 2/1989 | Yasui . | |
| 5,624,384 | 4/1997 | Chen | 601/135 X |
| 5,624,385 | 4/1997 | Hwang | 601/135 |

FOREIGN PATENT DOCUMENTS

| | | | |
|---|---|---|---|
| 467451 | 6/1914 | France | 601/135 |
| 2606633 | 5/1988 | France | 601/134 |
| 2637496 | 4/1990 | France | 601/135 |
| 1410944 | 10/1975 | United Kingdom | 601/134 |

*Primary Examiner*—Danton D. DeMille
*Attorney, Agent, or Firm*—Anthony G. Eggink

[57] ABSTRACT

A method and apparatus for the treatment of myofascial pain, RSI and mechanical injury to soft tissue. The apparatus includes a treatment tool having a construction and design so as to enable high pressure deep tissue massage sufficient to reduce both edema and nerve sensitivity. The treatment tool is constructed and arranged to provide a predetermined contoured treatment surface. Method steps are provided utilizing the treatment tool for soft tissue injury.

20 Claims, 5 Drawing Sheets

SOFT TISSUE INJURY TREATMENT APPARATUS AND METHOD

BACKGROUND OF THE INVENTION

This application claims the benefit of U.S. Provisional Application No. 60/010,877, filed Jan. 31, 1996, now abandoned.

This invention relates to a system for the treatment of myofascial pain, RSI (repetitive stress injury) and mechanical injury to soft tissue. The system includes a treatment tool and method of utilizing the tool to treat soft tissue injury. The tool, of a specific design, enables deep tissue massage sufficient to reduce both edema, nerve sensitivity and muscle tension. The tool structure and design and method steps of this invention are set forth herein and the discussion includes soft tissue problems, causes, diagnosis, risk factors, treatment requirements and treatment procedures. The apparatus and method of the invention provides a system for the treatment of soft tissue injury which may be utilized by professional health care providers and lay people.

In the past, there has been an inability of the medical establishment to effectively treat what is known as myofascial pain, CTD, RSI, or soft tissue injury. RSI means "repetitive stress injury," however, CTD or "cumulative trauma disorder" is also used to define such tissue injury. The lack of an effective and complete treatment regimen is often the result of misunderstandings of the causes and the nature of soft tissue injuries. Only recently has the medical community accepted that micro trauma of soft tissue can result in chronic muscle pain and muscle dysfunction. Edema is a local or generalized condition in which body tissues contain an excessive amount of fluid. Edema resulting from soft tissue injury results in the reduction of circulatory capacity and inhibits the body's ability to heal. Edema may contribute to degeneration of muscles, ligaments, tendons and joints. This application sets forth the cause of soft tissue injuries, the cause for and results of edema, the risk factors that influence injury cause and severity and the requirements and methods for treatment to enable anyone to treat soft tissue injury and/or to eliminate its occurrence/reoccurrence.

The terms myofascial pain, CTD, RSI or soft tissue injury all refer to muscle, tendon or ligaments having the condition where maximum tissue strength or maximum work strength has been exceeded causing damage resulting in chronic edema.

The treatment tool of this invention is designed to deliver high pressure to deep tissue and has a treatment surface approximately the area of a human thumb. Although the latter treatment area of the tool is preferable for most injuries and patients, various tool configurations and sizes are discussed herein. The treatment tool is designed to fit the natural grip of the hand, so that less strength and effort is needed in the proper use of the tool. The treatment tool provides a high pressure, deep tissue massage and may be used in the treatment for any soft tissue injury that is externally accessible on the human body. The construction of the tool includes a solid rod member which preferably acts as heat sink and which radiates heat back into the tissue under massage. Further, the tool may be heated by hot water or other medium before or during use or the tool may be heated as a result of friction caused by its use against cloth covering the area being treated. Further, the tool construction and design and its contact area enable a level of pressure to be created which is high enough to squeeze out edema and to over stimulate nerves in the injury site.

SUMMARY OF THE INVENTION

The method and apparatus of the present invention are used to treat what is known as CTD, RSI, myofascial pain or soft tissue injury. Flawed models have existed regarding the cause and nature of soft tissue injury and as a result the treatment regimen has generally not corrected damaged tissue. Presently, however, a greater acceptance exists that micro injuries can cause cumulative damage and the subsequent chronic problems in soft tissue, however, treatment has remained focused on the relief of symptoms. The method and apparatus of the present invention is designed to enable the treatment of soft tissue injury and/or eliminate its occurrence/reoccurrence. The tool or apparatus provided in the invention is designed to enable anyone to deliver the treatment specified with a minimum of effort, time and cost.

The treatment tool is designed to deliver high pressure to a selected treatment area of the body. The treatment tool has a rounded end formed by a large radius on the face and a smaller radius on the face and sides of the rod. The tool is provided having a knob portion that is designed so that the index finger of a user may be wrapped around its periphery. This configuration is used so less effort/strength is needed in the tool's use. The tool may be used in application for any soft tissue. The tool is preferably of a solid brass or like construction so that it acts as a heat sink and radiates heat back into the tissue undergoing massage, however, other constructions are further discussed below. The tool may be heated by hot water before or during use or may be heated as a result of friction during use of the tool against cloth covering the area being treated. The configuration of the tool allows a natural grip. The designs of the gripping portion of the tool and that of the treatment contact point effectively amplify the massage force. The tool configuration and design and the contact area of the tool result in a level of pressure sufficient to squeeze out edema and to overstimulate nerves in the injury site.

Among the benefits to a treatment facility and a treatment provider by the apparatus and method of the invention include that the system provides a non-invasive treatment which is low risk and easily taught and easily delivered. This system reduces the time required for treatment and which is effective and low in cost. Accessibility for use by the patient saves treatment expenses and reduces the work required by the treatment provider. The treatment tool is usable on any muscle group of the body and the provider can use the tool to avoid RSI. Additionally, the benefits to an insurance provider include that the tool is simple in construction, offers non-invasive treatment and is low in cost. Further benefits are that tool use can effectively restore normal muscle function and patient use of the tool eliminates costs required by the labor of a provider. The tool's use in application for soft tissue treatment and the availability of the tool encourages patient use for self maintenance to treat RSI and the like.

These and other benefits of this invention will become clear from the following description by reference to the drawings.

DESCRIPTION OF THE PREFERRED EMBODIMENT

Figure 1:
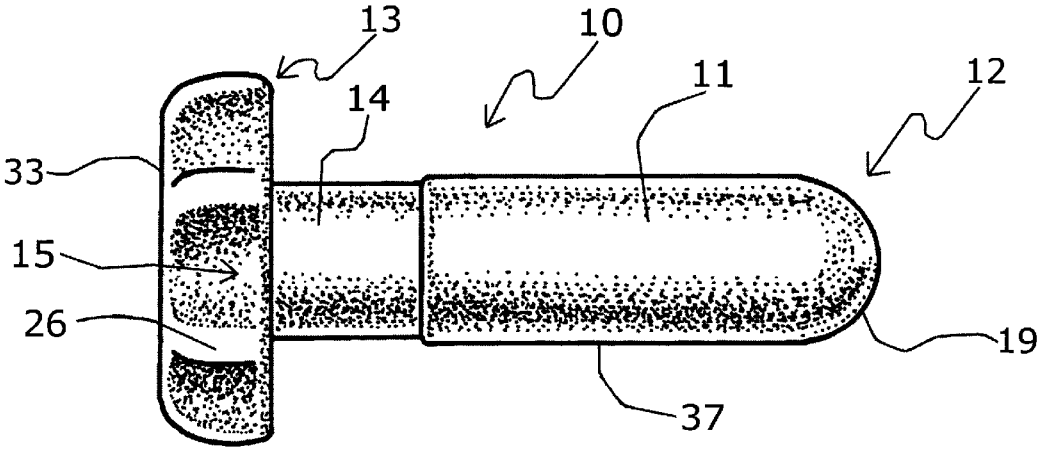
FIG. 1 is a side view of the treatment tool of the present invention.
Figure 2:
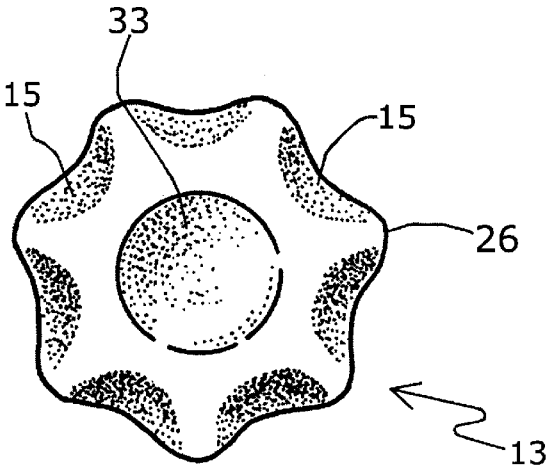
FIG. 2 is a top view thereof and showing the knob portion.
Figure 3:
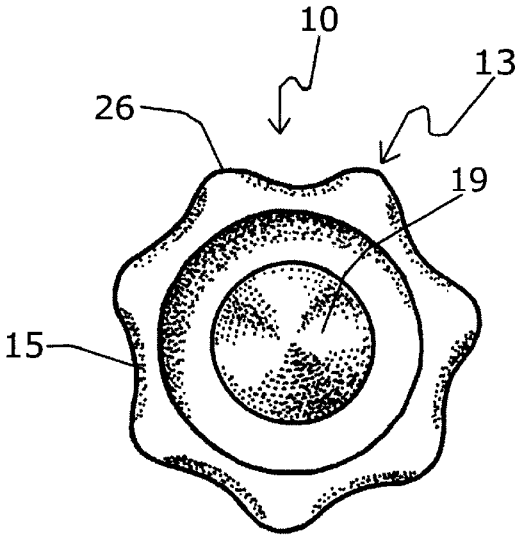
FIG. 3 is a bottom view of the treatment tool of FIG. 1.

Referring to FIGS. 1–3, treatment tool 10 of the present invention is shown and which is used in the treatment methods of the invention. The treatment tool 10 is comprised of an elongated rod 11 having treatment end 12. The treatment end 12 is a generally rounded terminal portion with a treatment surface 19 having a predetermined shape. As will be further described, the rounded end 12 has a configuration which is preferably comprised of a parabolic shape or one having two different radii. The rounded end 12 with treatment surface 19 is for contact with the body of a patient. As further shown, a knob member 13 is attached to the opposite end of the elongated rod 11.

Figure 4:
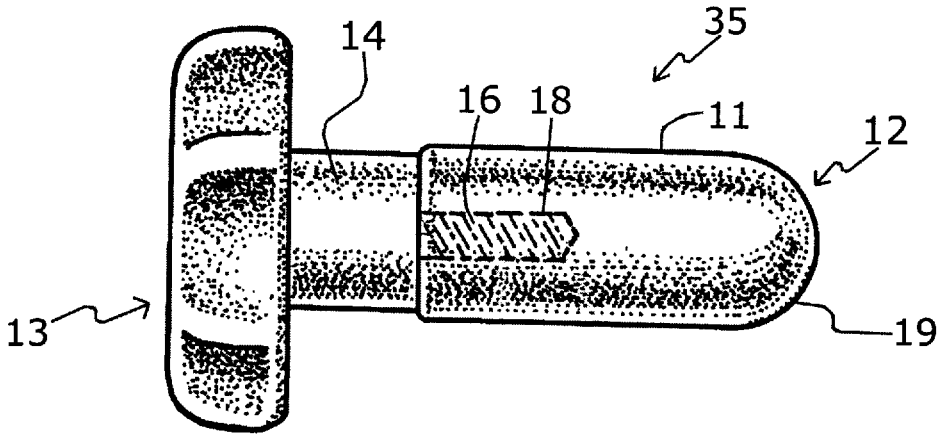
FIG. 4 is a side view of another embodiment of the treatment tool.

The knob 13 has a plurality of contoured portions 15 disposed about the periphery of the knob 13. The contoured portions 15 are provided for wrapping by the index finger of a user so that the tool may be used to treat deep tissue injury. The contoured portions 15 are shown separated by outer portions 26. The top of knob 13 is shown to have a flat top surface 33. The knob member 13 includes a shaft 14 for connecting to the elongated rod 11. A threaded shaft 16 extends from the knob shaft 14 and which is threadingly placed into the internal threaded aperture 18 of the rod 11, as shown in FIG. 4. The elongated rod 11 has a flat end 17 which abuts the knob shaft 14 when connected to knob member 13.

Figure 5:
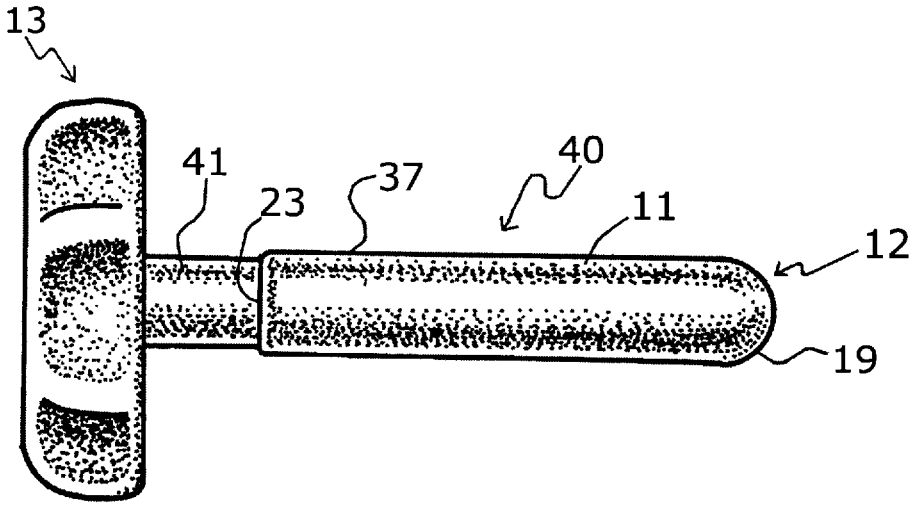
FIG. 5 is a side view of another embodiment of the treatment tool.
Figure 6:
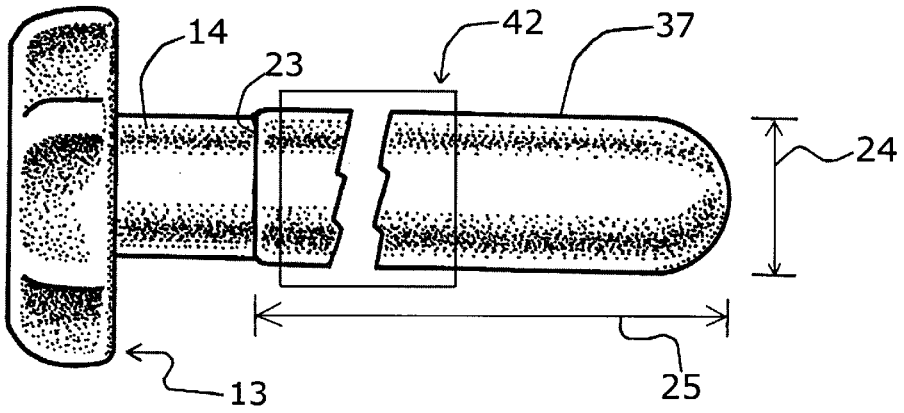
FIG. 6 is a side view of the treatment tool of the invention.

FIGS. 4 and 5 show alternate embodiments 35 and 40 of the treatment tool. Specifically, FIG. 4 shows a tool having a shorter shaft 11, while FIG. 5 shows a tool having a longer shaft 11 and one which has a smaller diameter. The sizes of the treatment tools may change in length and diameter to accommodate treatment of specific injury areas as will be further described below. FIG. 6 shows a treatment tool of indeterminate length. In essence, the length 25 and the diameter 24 may vary as treatment dictates. The embodiments of FIGS. 4–6 all have a knob member 13 attached to shaft 11. FIG. 4 shows the threaded bore 18 of shaft 11. The treatment tool may however be utilized without the knob 13. In the latter configuration of the treatment tool, the flat surface 23 of the shaft 11 would be the top of the tool for grasping by the user.

Figure 7:
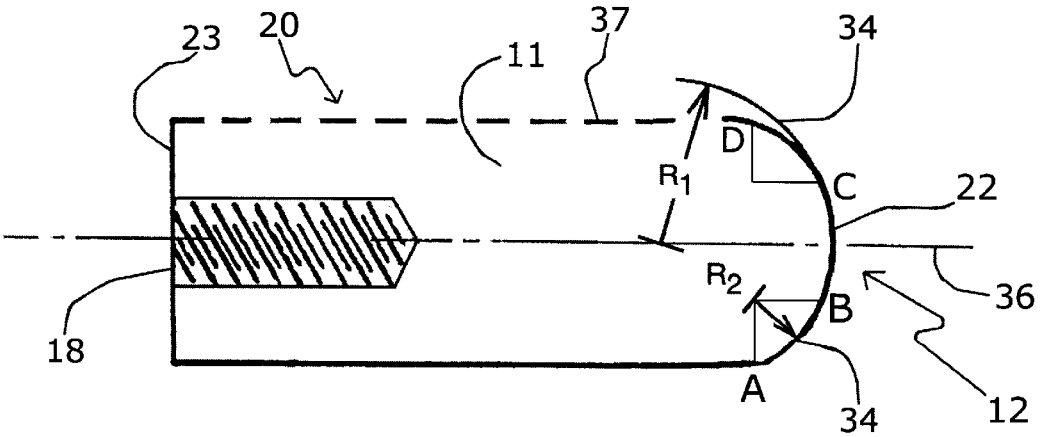
FIG. 7 is a side view of the tool and showing the treatment end thereof.

FIG. 7 shows an alternate embodiment 20 of the treatment tool of the present invention. The treatment tool 20 has an elongated rod body 21 with a rounded contact end 22 and an opposing flat end 23. The treatment 20 may be provided having a range of diameters 24 and a range of lengths 25, as shown in FIG. 6. The composition of the rod member 21 is preferably a metal, such as brass, stainless steel, bronze, copper or the like which acts as a heat sink. In other words, the rod composition, as shown in the respective drawing figures, is preferably a solid and rigid member having heat transfer characteristics. It is also within the purview of the invention to provide a tool which is plated with silver or gold. Also, a tool may be provided which is heated, i.e. wherein warm water is circulated through a sleeve covering a portion of the shaft, as will be discussed further with respect to FIG. 8.

The cylindrical shaft of FIG. 7 is shown to have a drilled and tapped bore 18 to receive the threaded shaft 16 of the knob structure 13. It is within the purview of this invention, however, for the shaft to not have such aperture and to by used as the treatment tool structure itself. The treatment end 12 is shown to be comprised of a contoured shape, as shown in cross-section with respect to centerline 36, and comprising radii $R_1$ and $R_2$. Segment B-C defined by $R_1$ extends to segments A-B and C-D which are defined by $R_2$. Thus, treatment end 12 is comprised of two segmented, curves of revolution, each of a different curvature, as shown by $R_1$ and $R_2$, and wherein $R_1$ is greater than $R_2$. As shown, the treatment surface 19 is comprised of the central contact surface 22 and adjoining surface 34.

As shown in FIG. 7, the shaft 14 of tool 10 has a rounded end 12 which is comprised of two different and distinct radii, $R_1$ and $R_2$. The larger radius ($R_1$) comprises the central treatment surface of the tool end 12. As further shown, the smaller radius ($R_2$) contours the treatment surface 19 to the side surface 37 of the shaft 11. The two radii, $R_1$, and $R_2$, are shown in cross-section in FIG. 7 and the radii are utilized to produce a circular segments of revolution to provide the treatment surface 19 of the tool 10. The intersection lines between $R_1$ and $R_2$ and between $R_2$ and the side surface of the shaft 14 are preferably smoothed or contoured to provide a smooth transition.

Figure 9:
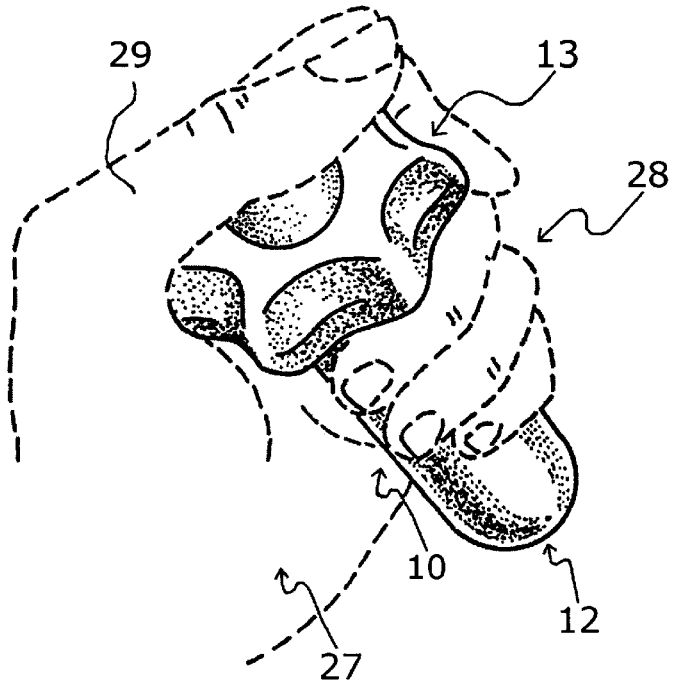
FIG. 9 is a perspective view of the treatment tool held in the hand of a user.

The scalloped knob 13 provides a gripping member which may also include configurations having different shapes such as a triangulated or nautical shell shape for ergonomic grip for a user as shown in FIG. 9.

The treatment surface 19 as shown in FIG. 7 is constructed and arranged to have a shape which may also be defined as a parabola of revolution with respect to centerline 36. This oval-like shape surface is flatter at its center ($R_1$) and more curved ($R_2$) up to meeting with the side surface 37 of the rod 11. This configuration has been found effective in the treatment of soft tissue injury. For example, a one inch diameter brass round bar stock having a 1⅛" $R_1$ and a 3/16" $R_2$ has been found suited for such treatment. Smaller diameter and larger diameter tools are preferred for specific treatment use.

Figure 8:
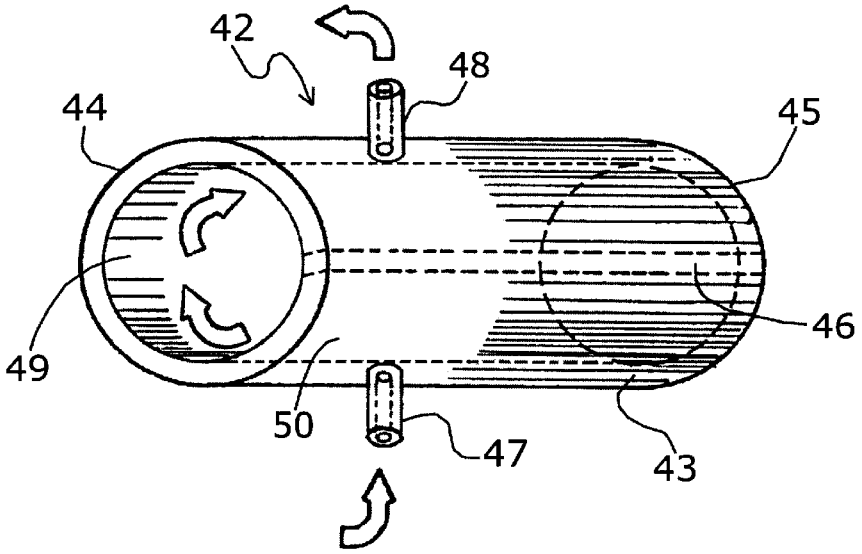
FIG. 8 shows a heating element for the treatment tool.

FIG. 8 shows a heating element 42 which may be positioned about the shaft 11 of treatment tool 10. The heating element 42 is a sleeve 43 having an inner surface 49 and an outer surface 50. Ends 44 and 45 secure the sleeve about the shaft 11 as shown in FIG. 6. The sleeve 42 has fluid ingress 47 and fluid egress 48. A divider 46 is molded within the sleeve 43 to direct fluid flow from the ingress portion to the egress portion of the sleeve. As shown, the entering fluid contacts the surface 37 of shaft 11. The sleeve 43 may be slipped over the shaft 11 so that warm fluid, such as water, may continually cause heat transfer through the shaft and to the treatment end 12.

The sleeve 43 may be constructed of a silicon rubber composition or the like. The connector members 47 and 48 shown extending from the sleeve 43 may be connected to tubes or conduits (not shown) extending from a fluid source and to a drain, respectively.

Figure 10:
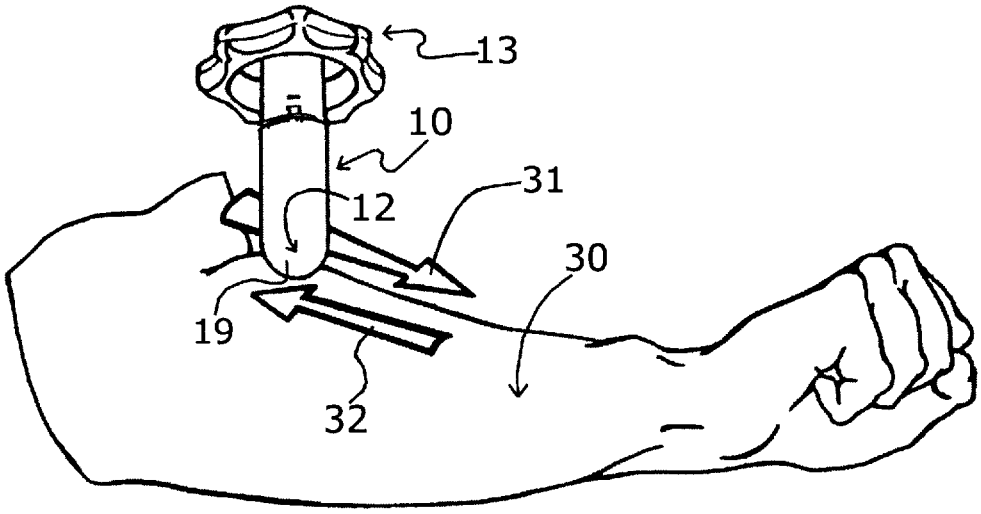
FIG. 10 is a perspective view showing the treatment tool being used on the forearm of a patient and illustrating the method of use of the treatment tool.

FIGS. 9 and 10 show the treatment tool 10 used in the method of the present invention. As shown, the tool 10 is held in the hand 27 of a user whereby the thumb 29 is placed over the top of the knob 13 and the fingers 28 are wrapped about the knob and rod 11 of the tool 10. This tool placement in hand 27 permits the user to manipulate and press the tool 10 to the portions of the body to be treated. FIG. 10 shows the tool to be moved in directions 31 and 32 on the top of the forearm 30 of a patient having an injury. The tool 10 is preferably worked along the entire muscle in a back and forth motion.

Regarding the treatment method of the present invention, a user may place a second hand on top of the hand as shown in FIG. 9. The second hand is used to grasp the first hand to thereby provide further downward pressure to the treatment surface of the tool and also to guide the tool 10 along the body portion to be treated. Alternatively, the tool 10 may be provided with a longer shaft 14 whereby the second hand is used to wrap around the shaft 14 and to thereby provide additional pressure and means to guide the tool for treatment purposes.

The terms myofascial pain, CTD, RSI, or soft tissue injury all refer to muscle, tendon or ligaments having the condition where maximum tissue strength or maximum work capacity has been exceeded causing damage resulting in chronic edema. The following is a discussion of edema, its causes, diagnosis and treatment.

EDEMA

Causes of edema: Injury to soft tissue (muscles, ligaments, tendons) from direct mechanical damage or RSI results in tissue damage of the body. Release of fluids and by-products such as lactic acid result in swelling. White blood cells scavenge damaged tissue adding to edema. Excess fluid will cause an increase of tissue pressure reducing blood flow resulting in additional build up of body waste products. This pressure may cause nerve stimulation resulting in chronic pathogenic muscle tension and acidosis.

Diagnosis: The major symptom of myofascial pain, CTD, RSI and soft tissue mechanical damage is pain. Pain may be chronic and/or arise with use of the affected tissue group. This pain may radiate - causing difficulty in locating the problem structure. Many health care practitioners refer to myofascial pain syndrome which refers to pain that occurs in muscles. It has been found that the most effective diagnostic tool is simple direct pressure applied to locate the problem structure. The immediate increase of pain/discomfort will show where tissue is suffering edema and also where the injury may be "silent."

Diagnosis in athletes: Evidence of RSI is apparent in many people who seem physically fit. Many athletes experience muscle shortening caused by overtraining. (The muscle has tightened or clenched in response to nerve signals indicating damage.) Clenching of muscle is a response by muscle to limit damage. This reduces the work capacity of the muscle by the percentage of shortening that has occurred. The need to stretch to relieve tightness indicates tissue trauma that has resulted in edema and clenching. This assessment is reinforced when stretching provides only temporary relief from tightness. Attempting to stretch will re-establish the clenching of the muscle. Stretching should be used to maintain muscle length after the muscle has been restored to the normal length and tension eliminated.

Risk factors: The classic risk factors of RSI are well known to industry and health care professionals. The obvious contributing factors are repetitive use of a muscle group, extreme angle or extreme range of motion or use of force great enough to directly exceed mechanical strength of the involved structure. Further risk factors that contribute to RSI fall into three (3) groups. The first factor results from the differing response of individuals in bruising and swelling. There is a range of a individual's response to injury, this response appears to vary with heredity, age and general overall physical condition. A greater tendency to swelling indicates greater risk to develop RSI. Second, overall structure and size of muscle groups governs muscular competence and, therefore, risk to injury. The smaller the muscle, the higher the risk of RSI. Third, RSI also appears to be associated with individuals who over use small muscle groups that have a limited capacity (volume and/or circulation) to accommodate swelling (forearm pain syndrome is further described below). In summary, the foremost risk of RSI results from the failure to treat edema caused by RSI and which may accompany any soft tissue injury.

Treatment requirements: Irrespective of where the soft tissue injury occurs, the treatment requirements are: 1) Reduce edema as rapidly as possible and keep swelling down for a period of time sufficient to allow the body to completely heal the injured tissue; 2) Maintain blood flow to the affected and surrounding tissue; 3) Over stimulate nerves involved in order to reduce pathogenic muscle tension; and 4) Restore muscle to normal length.

Treatment method: Upon injury the first action is to limit the formation of edema. The preferred method may include a topical application of a mixture of herbs commonly referred to as bruise medicine or Dit - Da - Jow (Chinese). Formulas of this medicine vary but most cultures have herbs that limit edema. Ice may be used but excessive use of ice may impede circulation and slow the healing process. Further reduction of edema is effected by the use of the hand held treatment tool of the present invention which is used directly on the injured tissue. This treatment may begin immediately. High pressure deep tissue massage can be applied through a layer of cloth, such as cotton denim, massage should be applied on the full length of the tissue structure. Friction against the cloth heats the massage tool which radiates into the structure being treated, thus, benefitting circulation. Massage can be initiated immediately after injury; pressure may start out light and increase as endorsing levels rise. Use of the treatment tool directly on the skin surface will enable a higher level of delivered pressure, but this procedure preferably requires a lubricant. The treatment tool may be warmed by water wash before and during use. Use of the injured structure at reduced level of exertion is encouraged to prevent atrophy, minimize negative change in fascia and to preserve range of motion during healing. Treatment by high pressure deep tissue massage should continue daily to reduce edema and permit healing of damaged tissue. This treatment should continue for a period sufficient to permit full healing, i.e., a minimum two (2) weeks. Severe and/or chronic injuries may require 5–6 weeks of daily treatment. Daily use to maintain tissue under constant use and, therefore, at risk to RSI should be approximately five (5) minutes daily. Any injury to spinal structures or any skeletal injury must be addressed by a competent physician, chiropractic or osteopathic practitioner. Any one at risk of blood clotting should consult with a physician before utilizing high pressure, deep tissue massage.

SPECIFIC INJURY SYNDROMES

The following is an injury list to guide a user of the system of the invention in first use treatment of common problems that may result from soft tissue injury.

Forearm pain—injury to extensor muscles of the wrist and fingers. Usual cause is micro trauma (RSI). Pain radiates and is often mistaken for carpal tunnel, or attributed to tennis elbow. Injury may result from writing, use of keyboard, carpentry (hammering), use of hand tools (screwdrivers), repetitive factory work. Forearm injury may also affect flexors of the wrist and fingers from heavy lifting, such as carrying buckets.

Many women suffer arm pain that is incorrectly attributed to carpal tunnel syndrome because they experience pain that radiates the length of the forearm. The majority of these individuals have soft tissue edema in the extensor muscles of the wrist and fingers. This edema puts pressure on nerves and the pain in turn radiates through the forearm. Risk factor: The tendency of the extensor muscles of the wrist and fingers to swell is often due to writing technique, i.e., the pressing of the heal of the hand on the paper for a stable base. This procedure isolates writing motions to the flexor and extensor muscles of the thumb, forefinger and middle finger. The small muscles of a person of small physique are easily over taxed causing micro damage that accumulates and creates a level of edema. Further use of extensors of the hand and fingers, (by typing with a keyboard that causes the wrists to bend back, for example) may cause enough additional micro trauma to trigger full blown RSI symptoms.

Backache—injury to muscles of the back may result from being bent over for extended periods (RSI damage), or attempting to lift too large a weight incorrectly using back muscles instead of the legs. Injuries due to participation in sports, such as golf, may cause mechanical or micro damage in various muscle groups; application of pressure to help locate injured areas is the most efficient means to determine the extent of injury.

Shoulder pain—often attributed to rotator cuff injury but often the result of edema in the area of the anterior head of the deltoid resulting in nerve impingement (and reduction of circulation) causing pain and muscle weakness. Treatment by high pressure deep tissue massage to the muscle that is swollen (painful). (Biceps tendon, rotator cuff muscles and tendon, coracobrachialis and deltoid muscle.)

Neck and shoulder soreness—the result of RSI and resulting accumulation of micro trauma results in pathogenic muscle tension and chronic stiff neck. Muscles involved trapezuis, posterior muscles of the spine.

Calf cramping—may cause problems that interfere with sleep, and may cause muscle shortening of significant amount which results in the risk of damage to the Achilles tendon. May affect the gastrocnemius but normally shows the most effect upon the muscles between the calve muscle and the tibia/fibula. (Tibialis posterior, flexor hallucis longus, flexor digitorum longus and soleus.)

Shin Splints—result of RSI to the extensor muscles of the ankle and toes. Small muscle groups to the outside of the shin. (Anterior tibial, extensor digitorum longus, extensor hallucis longus.) (Also referred to as anterior compartment syndrome).

Whip lash injury—injury by over stress during automotive rear end collisions. Pain symptoms appear at the time of injury or may take a period of hours to appear; coincides with the onset of edema resulting from the injury. Treatment is focused on the upper back junction and the neck muscles that have been over stressed during the collision. Women typically suffer a higher incidence of whip lash injury due to their smaller musculature.

The treatment tool 10 as shown in the drawings as well as the other embodiments of the tool are used in the treatment of the above described injuries. The treatment tool of the invention is designed to deliver high pressure to an area approximately the area of a thumb. The tool is also designed to fit the natural grip of the hand, so that less strength is needed in its use. The treatment tool may be used in the application for any soft tissue injury, as discussed. The tool's brass construction acts as heat sink and radiates heat back into the tissue under massage. Further, the treatment tool may be heated by hot water or other fluid before or during use. Alternatively, the tool may be heated by friction as a result of use of the tool against cloth covering the area being treated. Further, the tool configuration and design and contact area enable a level of pressure high enough to squeeze out edema and over stimulate nerves in the injury site.

As discussed, the treatment tool may have various configurations, sizes and may be constructed of various materials. For example, exemplary tool constructions may include bar stock which consists of various metals, may be plated and may have an internal cavity wherein medications may be placed for use on the injury site. The internal cavity may have an interconnecting channel or channels to the exterior of the rod whereby the medication may be metered onto the body during high pressure deep tissue massage. These structures are exemplary and are not exhaustive, however.

As many changes are possible to the tool embodiments and methods of this invention utilizing the teachings thereof, the descriptions above, and the accompanying drawings should be interpreted in the illustrative and not the limited sense.

That which is claimed is:

1. A method of treating soft tissue injury by use of high pressure massage comprising the steps of:

a) identifying the soft tissue injury area in the body of a patient;

b) providing a treatment tool for placement in the hand of a user to provide high pressure massage, said treatment tool comprising:

a cylindrical shaft having a predetermined diameter and a predetermined length, said cylindrical shaft having a bottom end and a top end;

a contoured massaging end disposed at said bottom end, said contoured bottom end having a treatment surface; and a knob member attached at said top end, said knob member having a diameter greater than said diameter of said shaft, said knob further having a peripheral surface area;

c) grasping said tool about said cylindrical shaft and said knob member whereby the thumb is placed over the top surface of said knob, whereby the index finger is wrapped about the periphery of said knob and whereby the small, ring and middle fingers are wrapped about said shaft; and d) forcing said treatment surface of said contoured bottom end into said soft tissue injury area and stroking said tool in a back and forth motion thereon.

2. The treatment method of claim 1 wherein said cylindrical shaft is provided with a knob member attached to said top end of said cylindrical shaft; said knob member having a diameter greater than said diameter of said cylindrical shaft and further having a circumferential surface for grasping by a portion of the hand of a user.

3. The treatment method of claim 1 wherein said treatment tool is provided with a heating element to thereby transfer heat to the injury area.

4. The treatment method of claim 1 wherein an herbal mixture is supplied to the treatment area of the patient.

5. A treatment tool to provide high pressure massage to deep tissue of a patient comprising a cylindrical rigid shaft member having a top end and a bottom end and wherein said bottom end has a contoured treatment surface comprised of a rounded surface having an inner area and an outer area, said inner area being defined in cross-section by a first radii and said outer area being defined in cross-section by a second radii, said first radii being larger than said second radii.

6. The treatment tool of claim 5 wherein a knob member is attached to said top end of said shaft.

7. The treatment tool of claim 6 wherein said knob member has an irregular circumferential surface for gripping by the user.

8. The treatment tool of claim 5 wherein said rigid shaft member is constructed of a material selected from the group of materials consisting of brass, stainless steel, bronze and copper.

9. The treatment tool of claim 8 wherein said shaft member is plated with silver or gold.

10. The treatment tool of claim 5 wherein a heat source is connected to said shaft member.

11. A treatment tool to provide high pressure massage to deep tissue of a patient comprising a cylindrical rigid shaft member having a top end and a bottom end and wherein said bottom end has a contoured treatment surface comprised of a rounded surface having an inner area and an outer area, said inner area being defined in cross-section by a first radii and said outer area being defined in cross section by a second radii, said first radii being larger than said second radii, said shaft member further being of a solid construction and having heat retention properties, whereby the movement of the treatment tool on the clothing of a patient causes frictional heat to be transferred to the shaft of the tool and then radiated to the tissue being treated.

12. The treatment tool of claim 11 wherein said rigid shaft member is constructed of a metallic material selected from the group of brass, stainless steel, bronze and copper.

13. A treatment tool to provide high pressure massage to the deep tissue of a patient, comprising:

a cylindrical shaft constructed of a rigid material having a predetermined diameter and a predetermined length, said cylindrical shaft having a bottom end and a top end;

a rounded high pressure massaging end disposed at said bottom end, said rounded bottom end having a terminal massaging surface comprised of a rounded surface having an inner area and an outer area, said inner area being defined in cross-section by a first radii and said outer area being defined in cross-section by a second radii, said first radii being larger than said second radii; and a knob member attached to said top end of said cylindrical shaft; said knob member having a diameter greater than said diameter of said cylindrical shaft and further having a circumferential surface for grasping by a portion of the hand of a user.

14. The treatment tool of claim 13 wherein said cylindrical shaft is comprised of a brass material.

15. The treatment tool of claim 13 wherein said circumferential surface of said knob has a plurality of scalloped areas for gripping by the user.

16. The treatment tool of claim 13 where in said top end of said cylindrical shaft has a threaded aperture and wherein said knob member has a threaded shaft for screwing into said threaded aperture of said cylindrical shaft to thereby secure said knob to said shaft.

17. The treatment tool of claim 13 wherein said knob is comprised of a molded plastic handle.

18. The treatment tool of claim 13 wherein said cylindrical shaft has a diameter ranging from approximately ⅜ to 1½ inches.

19. The treatment tool of claim 13 wherein said tool has a total length ranging from approximately 4 to 8 inches.

20. A treatment tool to provide high pressure massage to the deep tissue of a patient, comprising:

a) a cylindrical shaft constructed of a solid, rigid material having a predetermined diameter and a predetermined length, said cylindrical shaft having a lateral surface, a bottom end and a top end;

b) a rounded high pressure massaging end disposed at said bottom end, said rounded bottom end having a terminal massaging surface comprised of a rounded surface having an inner area and an outer area, said inner area being defined in cross-section by a first radii and said outer area being defined in cross-section by a second radii, said first radii being larger than said second radii.

c) a knob member attached to said top end of said cylindrical shaft; said knob member having a diameter greater than said diameter of said cylindrical shaft and further having a circumferential surface for grasping by a portion of the hand of a user; and d) a heat source attached to said lateral surface of said cylindrical shaft, said heat source being comprised of a flexible sleeve wrapped about said shaft and wherein said sleeve has fluid ingress and egress means.

* * * * *